United States Patent [19]

Kellerman et al.

[11] Patent Number: 4,558,855

[45] Date of Patent: Dec. 17, 1985

[54] DEVICE FOR COMPRESSING ARTICLE HOLDING RACKS

[76] Inventors: Richard J. Kellerman, 4160 Fruitville Rd., #28, Sarasota, Fla. 33582; Clifford L. Beal, 209 N. Briggs Ct., Sarasota, Fla. 33577

[21] Appl. No.: 546,657

[22] Filed: Oct. 28, 1983

[51] Int. Cl.[4] ..... B25B 1/16

[52] U.S. Cl. ..... 269/158; 269/216; 269/221

[58] Field of Search ..... 269/155, 156, 158, 159, 269/164, 216, 221; 204/297 W

[56] References Cited

U.S. PATENT DOCUMENTS

| | | | |
|---|---|---|---|
| 557,453 | 3/1896 | Thompson . | |
| 666,196 | 1/1901 | Howe | 269/156 X |
| 738,055 | 9/1903 | Newnam . | |
| 849,904 | 4/1907 | Kovács | 269/221 X |
| 923,323 | 1/1909 | Bridges | 269/158 |
| 1,121,603 | 12/1914 | Baron . | |
| 1,720,416 | 4/1985 | Harvey | 269/156 X |
| 1,759,036 | 5/1930 | Brantingham . | |
| 1,799,526 | 4/1931 | Nylander | 269/158 X |
| 2,141,887 | 12/1938 | Thomas . | |
| 3,176,850 | 4/1965 | Rosner . | |
| 3,314,877 | 4/1967 | Novitsky . | |
| 3,615,087 | 3/1969 | Hickman . | |
| 3,856,290 | 12/1974 | Jensen et al. . | |
| 4,095,778 | 6/1978 | Wing . | |
| 4,295,914 | 10/1981 | Checko . | |

FOREIGN PATENT DOCUMENTS

| | | | |
|---|---|---|---|
| 366047 | 7/1930 | United Kingdom | 269/159 |
| 1249342 | 10/1971 | United Kingdom | 269/156 |

*Primary Examiner*—Frederick R. Schmidt
*Assistant Examiner*—Steven P. Schad
*Attorney, Agent, or Firm*—Benjamin P. Reese, II

[57] ABSTRACT

A device for simultaneously compressing a row of resilient finger pairs on an article holding rack to facilitate placement and removal of articles. A pair of opposed, plate-like jaws are supported in the same horizontal plane by a pair of parallel, L-shaped side walls which are in turn supported by a support frame. One of the plate-like jaws is fixed and the other is moveable on a pair of bearing blocks, each of which travels on a horizontally positioned bearing way. Hand and foot actuators are provided for moving the moveable plate-like jaw adjacent to the fixed plate-like jaw to compress the finger pairs. The hand and foot actuators which are provided include a pair of counterbalanced dogleg lever arms which act on vertical plates fixedly attached to the under surface of the moveable plate-like jaw. The moveable jaw is first moved into position for compressing with the handle and then further moved to compress the finger pairs with the foot pedal.

10 Claims, 7 Drawing Figures

DEVICE FOR COMPRESSING ARTICLE HOLDING RACKS

BACKGROUND OF THE INVENTION

This invention relates generally to the coating of articles by conventional processes, such as electroplating and anodizing, and more particularly to a device for simultaneously compressing a row of resilient finger pairs on an article holding rack to facilitate placement and removal of articles.

Electroplating and anodizing processes necessarily involve the proper suspension of the articles to be plated or anodized in an electrolytic or other depositing solution. A common method of suspending such articles involves the use of an article holding rack having a plurality of resilient finger pairs each of which is capable of receiving and retaining a metal article which is essentially hollow or has a suitable indentation. Typically, the rack comprises a bar, rod or other similar elongated member having a supporting hook on one end. The resilient finger pairs are typically affixed to the elongated member in opposed, longitudinal rows with the free ends of each finger pair diverging outward from a common point. Similar article holding racks are sometimes used during other coating processes, such as spray painting, dip painting and vacuum metalizing.

The conventional method for placing articles on an article holding rack is to first manually compress the diverging free ends of a finger pair and then manually place the hollow or indented portion of an article over the compressed free ends. Upon release of the compressed finger pair, the article is caught and retained by the outward spring bias of the resilient fingers. This process is repeated until all of the finger pairs on the rack have an article caught and retained on their free ends. Unfortunately, the conventional method is rather tedious and time consuming since a typical article holding rack is capable of receiving and retaining a substantial number of articles. The conventional method of removing articles from an article holding rack following electroplating, anodizing or other coating processes again involves separately and independently manually compressing all of the resilient finger pairs on the rack to release the articles caught and retained thereon.

A pneumatic press for receiving an article holding rack having two opposed rows of resilient finger pairs and simultaneously compressing all of the finger pairs on the rack to facilitate placement of the hollow or indented portion of an article over the free ends of each finger pair is disclosed in U.S. Pat. No. 3,856,290, issued to Jensen, et. al., for an "Apparatus for Compressing Article Holding Racks". A similar pneumatic press which includes means for removing the articles from the free ends of the finger pairs is also disclosed in U.S. Pat. No. B 3,856,290. While such presses represent a substantial improvement over the conventional article placement and removal methods described above, they are relatively expensive to manufacture and difficult to use. For example, since the resilient finger pairs are horizontally positioned for compressing by such presses, the articles which are being placed on the free ends of the compressed finger pairs often fall off during the placement process. Furthermore, such presses cannot be used to compress the resilient finger pairs on article holding racks other than those having two opposed rows of finger pairs.

It is desirable to have a simple and inexpensive device for receiving an article holding rack and simultaneously compressing a row of resilient finger pairs on the rack to facilitate placement or removal of articles. It is not believed that the prior art provides such an article holding rack or any other device which is readily adaptable for such use.

SUMMARY OF THE INVENTION

The present invention provides a new and improved device for simultaneously compressing a row of resilient finger pairs on an article holding rack to facilitate placement and removal of articles.

The device of the present invention comprises a support frame, a pair of identical, parallel L-shaped side walls, a first plate-like jaw fixedly supported in a horizontal plane by the side walls, a second plate-like jaw moveably supported in the same horizontal plane by the side walls, and hand and foot operated means for moving the second plate-like jaw in the horizontal plane. An article holding rack having a plurality of resilient finger pairs arranged in longitudinal rows is positioned between the plate-like jaws with one row of its finger pairs positioned vertically. If it is desired to place articles on the free ends of the finger pairs in that row, the free ends are upwardly positioned. The free ends of the finger pairs in that row are downwardly positioned if it is desired to remove articles therefrom. When the second plate-like jaw is moved adjacent to the first plate-like jaw, the free ends of the finger pairs in that row are compressed.

In the preferred embodiment of the device of the present invention, the support frame comprises a tabletop and four vertically disposed legs, one leg at each corner of the tabletop. The longer portion of each of the L-shaped side walls rests on and is fixedly attached to the tabletop. The shorter portion of each of the L-shaped side walls extends upward and the first plate-like jaw rests thereon and is fixedly attached thereto. The longer portion of each of the L-shaped side walls has a horizontally positioned bearing way fixedly attached thereto with appropriate clearance for a bearing block. Each of the bearing ways has a bearing block moveably positioned thereon. The second plate-like jaw rests on and is fixedly attached to a pair of spacers, each of which rests on and is fixedly attached to one of the bearing blocks.

The hand and foot operated means for moving the second plate-like jaw in the horizontal plane which is used with the preferred embodiment of the device of the present invention comprises a pair of dogleg lever arms, each of which is pivotedly attached to one of the L-shaped side walls, a foot pedal having a pair of side rails, each of which is pivotedly attached to one leg of the support frame, a pair of counterweights, one of which counterbalances the dogleg lever arms and the other of which counterbalances the bearing blocks, an elongated handle, and a plurality of connecting cables. A pair of vertically disposed plate-like members are fixedly attached to the underside of the second plate-like jaw. Each of these plate-like members is positioned to engage a roller bearing rotatably positioned in a fork on the end of the shorter portion of one of the dogleg lever arms. When the operator of the device moves the handle downard, the second plate-like jaw moves into position adjacent to the first plate-like jaw and the foot pedal drops into position to enable the operator to compress a row of resilient finger pairs. The operator presses the foot pedal downward to pivot the dogleg lever arms to push the vertically disposed plate-like members, and, thereby further move the second plate-like jaw to compress the finger pairs.

These and many other advantages, features and objects of the present invention will be apparent from the following Brief Description of the Drawings, Detailed Description of the Preferred Embodiment and Claims, and the accompanying Drawings.

DETAILED DESCRIPTION OF THE PREFERRED EMBODIMENT

The preferred embodiment of the device for compressing article holding racks of the present invention is illustrated in FIGS. 1–7.

Figure 1:
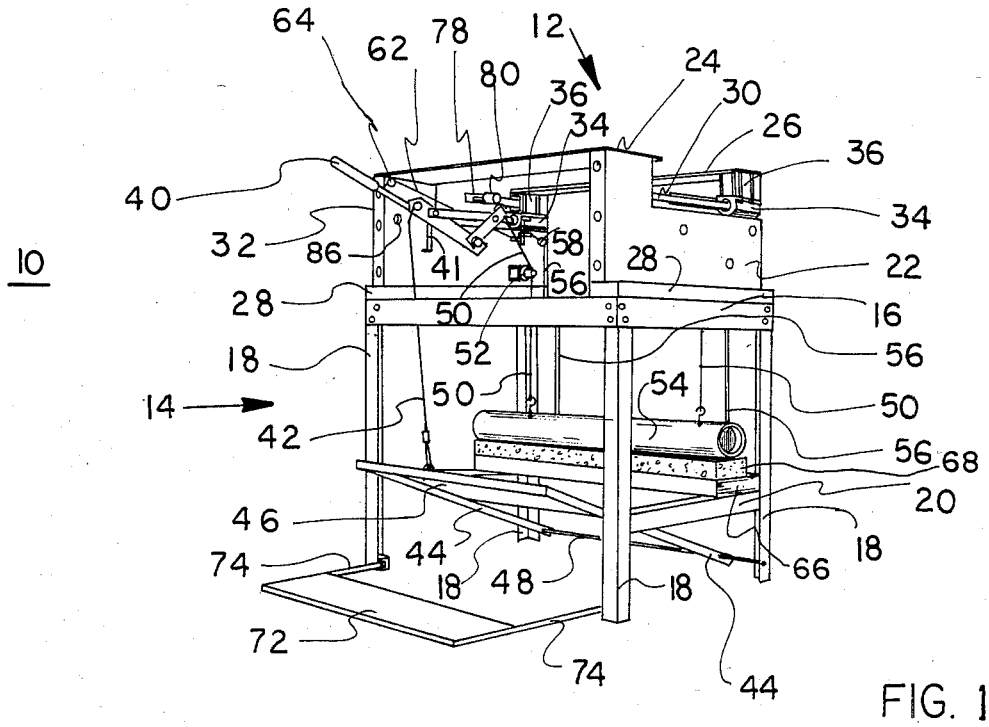
FIG. 1 is a perspective view showing the front and right side of the preferred embodiment of the device of the present invention with its moveable plate-like jaw open.
Figure 2:
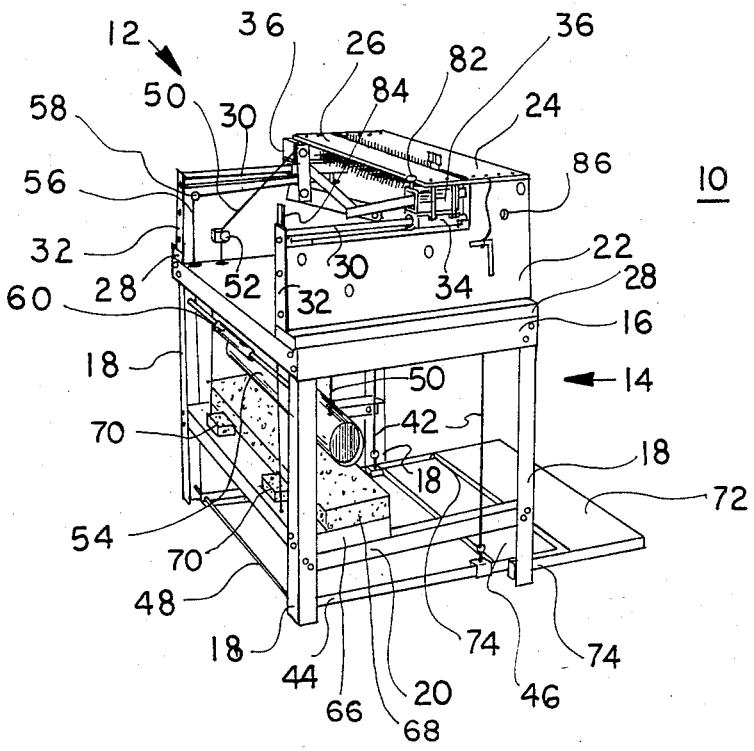
FIG. 2 is a perspective view showing the rear and left side of the device of the present invention with its moveable plate-like jaw closed and an article holding rack in position.

Referring initially to FIGS. 1 and 2, the reference numeral 10 generally designates the device for compressing article holding racks which is illustrated. The device 10 comprises a hand and foot operated rack compressing assembly 12 mounted on a support frame 14. While various forms for the support frame 14 are possible, a conventional table having a tabletop 16 or the like and four vertically disposed legs 18, one at each of its corners, has proved to be both satisfactory and inexpensive. A horizontal brace 20 interconnects the front and rear legs 18 on both the right and left sides of the frame 14 to stiffen its structure.

The rack compressing assembly 12 comprises a pair of identical, parallel, L-shaped side walls 22, a first plate-like jaw 24 fixedly supported in a horizontal plane by the side walls 22, a second plate-like jaw 26 moveably supported in the same horizontal plane by the side walls 22, and hand and foot operated means for moving the second plate-like jaw 26 in the horizontal plane. Each of the L-shaped side walls 22 is positioned such that its longer portion rests on and is fixedly attached to the tabletop 16, or a supporting foot 28 which in turn rests on and is fixedly attached to the tabletop 16, and its shorter portion extends upward to support the first plate-like jaw 24 at the front of the rack compressing assembly 12. As illustrated, each of the L-shaped side walls 22 is formed from a metal or wooden plate which is cut to achieve the desired configuration. However, it is possible to form each of the L-shaped side walls 22 from a plurality of individual structural members, such as two metal channels, one larger than the other, which are fastened together by bolting, welding or other conventional means.

By positioning the L-shaped side walls 22 in the manner described above, space is provided below the level of the horizontal plane containing the first and second plate-like jaws 24 and 26 to horizontally position the means for moveably supporting the second plate-like jaw 26. As illustrated, each of the L-shaped side walls 22 has one end of a bearing way or shaft 30 fixedly attached to its shorter portion at a point above the intersection between its shorter portion and its longer portion. The other end of each of the bearing ways or shafts 30 is fixedly attached to a vertically positioned plate 32 which in turn is fixedly attached to the rear end of the longer portion of the same L-shaped side wall 22. Other means for horizontally positioning the bearing ways or shafts 30 at an appropriate distance above the longer portions of the L-shaped side walls 22 are possible. For example, the opposite ends of each of the bearing ways or shafts 30 could be supported by L-shaped brackets which are fixedly attached to the top surface of the longer portion of one of the L-shaped side walls 22.

A conventional linear bearing block 34 is moveably positioned on each of the bearing ways or shafts 30 in the conventional manner. The Thomson Superball Bushing Twin Pillow Block, Type TWN-12, marketed by Thomson Industries, Inc., Manhasset, New York, has proved to be a particularly suitable bearing block for this purpose. As illustrated, each end of the second plate-like jaw 26 rests on and is fixedly attached to a spacer 36 which in turn rests on and is fixedly attached to one of the bearing blocks 34. Alternatively, the second plate-like jaw 26 can be attached directly to the bearing blocks 34 by providing an appropriately sized, integrally formed spacer on each end of the plate-like jaw 26. Of course, spacers are not necessary if the bearing blocks 34 which are used as components of the rack compressing assembly 12 are of a height which is sufficient to provide the necessary operational clearance.

Figure 6:
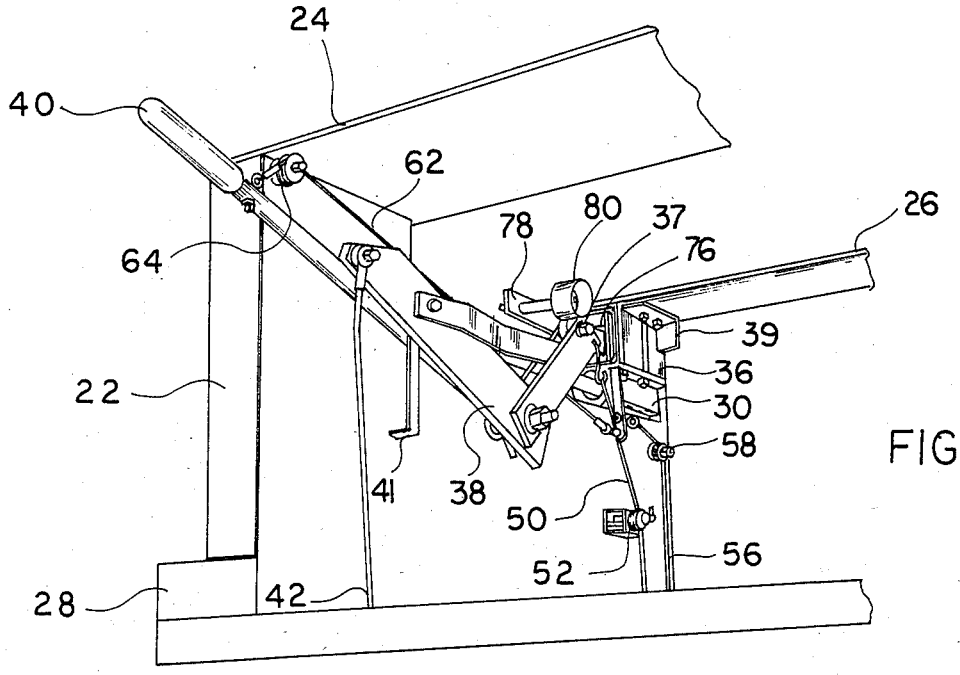
FIG. 6 is a perspective view of a portion of the upper left interior of the device of the present invention with its moveable plate-like jaw open showing certain of the details of its mechanical linkage.
Figure 7:
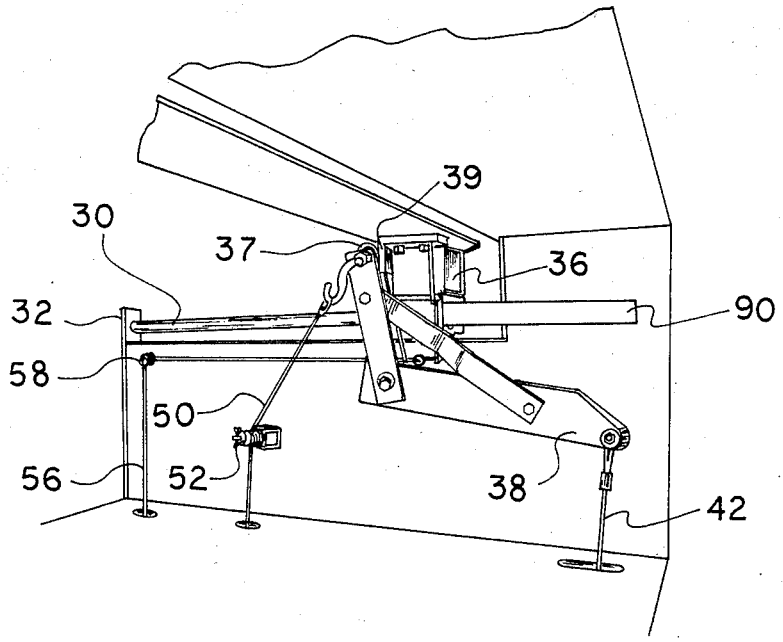
FIG. 7 is a perspective view of a portion of the upper right interior of the device of the present invention with its moveable plate-like jaw closed showing certain of the details of its mechanical linkage.

Various mechanical, electromechanical, and pneumatic means for moving the bearing blocks 34 along the bearing ways or shafts 30, and, thereby, moving the second plate-like jaw 26 in the horizontal plane which it shares with the first plate-like jaw 24, are suitable for use with the rack compressing assembly 12. However, the hand and foot operated mechanical linkage and counterweight system illustrated in FIGS. 1–3, 6 and 7 has proved to be particularly suitable for this purpose. Referring initially to FIGS. 6 and 7, each of the L-shaped side walls 22 has an identical, dogleg lever arm 38 pivotably attached thereto in the interior of the rack compressing assembly 12. The shorter portion, i.e, rearwardly projecting portion, of each of the dogleg lever arms 38 is forked and has a conventional ball bearing 37 rotatably mounted in its free end which operatively engages a vertically disposed plate-like member 39 fixedly attached to the under surface of the second plate-like jaw 26. While the dogleg lever arms 38 are illustrated as comprising four plate-like members which have been bolted together, it would be entirely satisfactory to form the lever arms 38 by welding the four members together or by casting or forging a single member having an appropriate shape.

Figure 3:
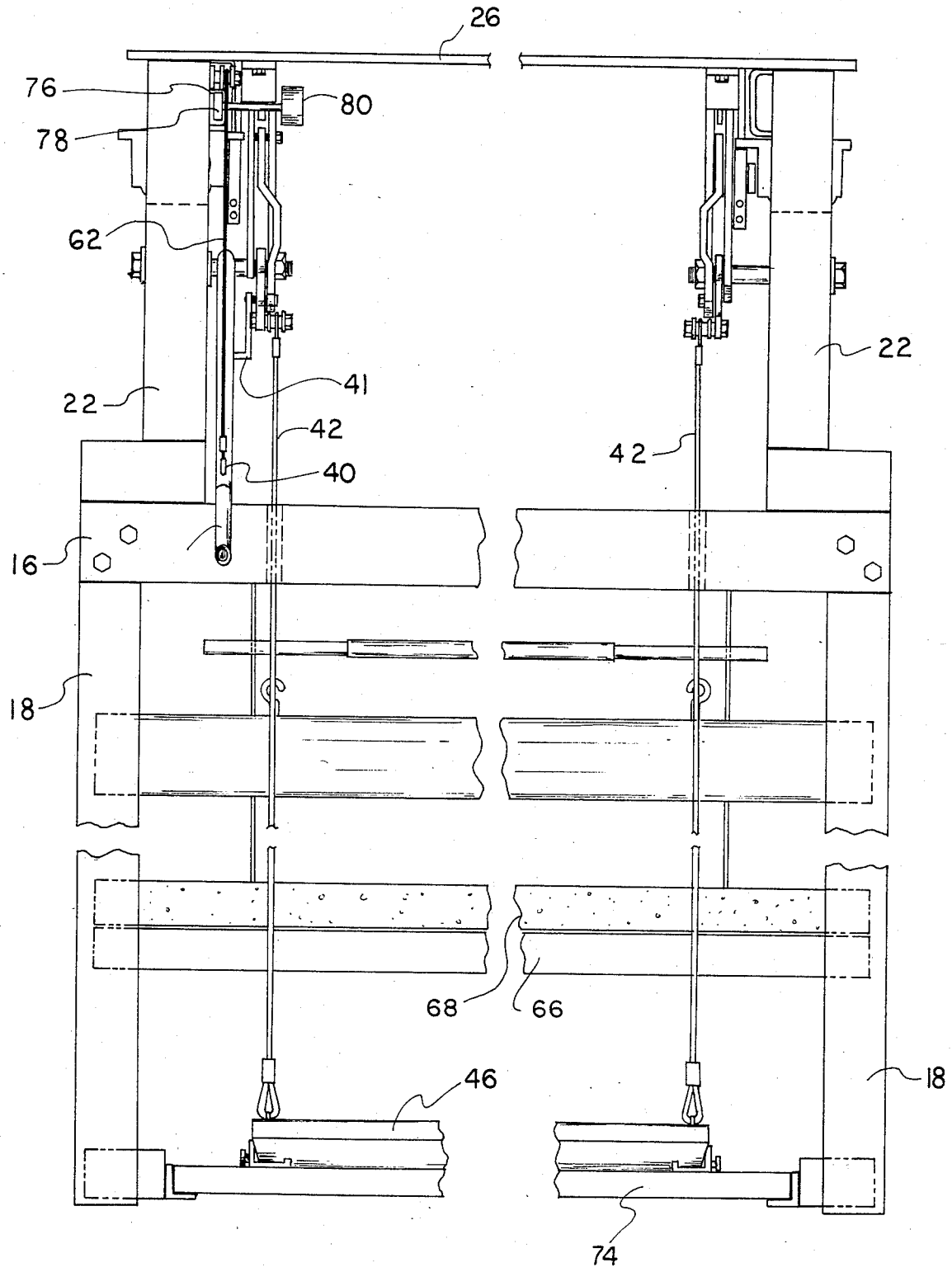
FIG. 3 is a partial front elevational view of the device of the present invention with its moveable plate-like jaw closed.
Figure 4:
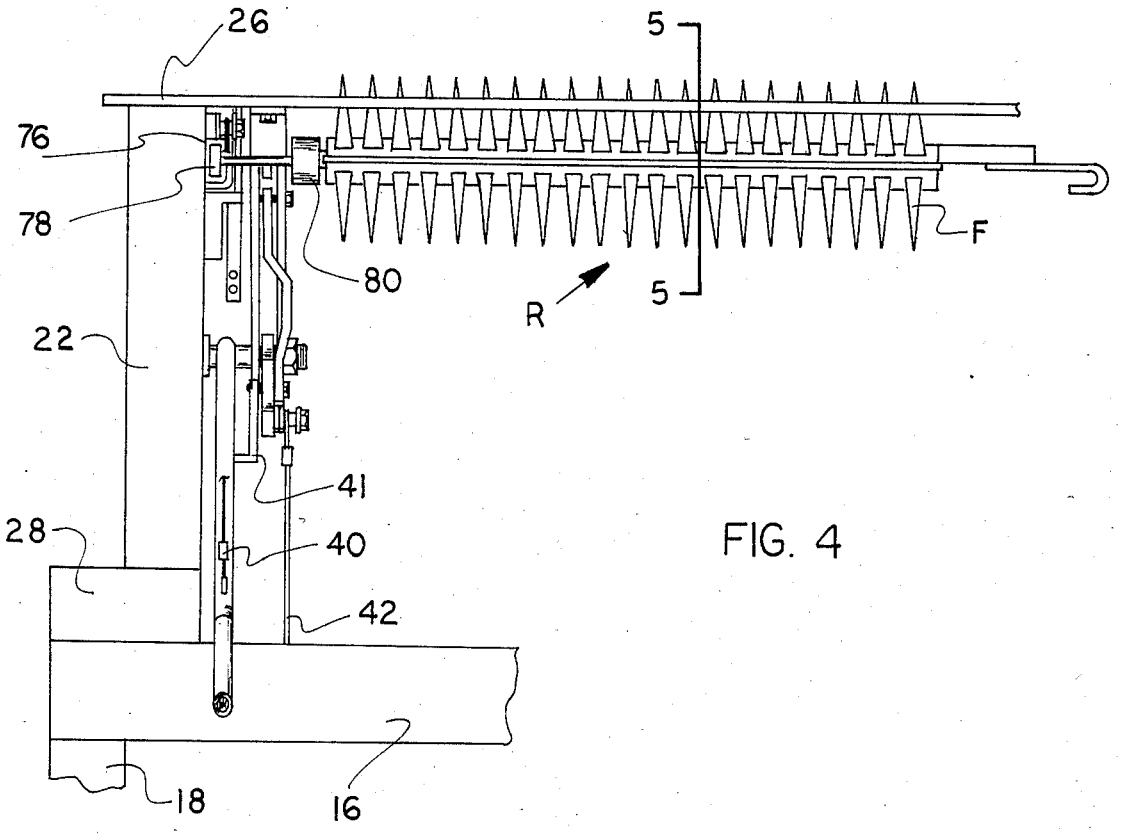
FIG. 4 is a partial front elevational view of the device of the present invention with its moveable plate-like jaw closed showing an article holding rack in position.

An elongated handle 40 is pivotedly attached to the L-shaped side wall 22 in the interior of the rack compressing assembly 12. While a common shaft may be used to pivotedly attach both the left dogleg lever arm 38 and the handle 40 to the side wall 22 as best illustrated in FIGS. 3 and 4, a common pivot point is not necessary for operation of the rack compressing assembly 12. Therefore, the left dogleg lever arm 38 and the handle 40 may be pivotedly attached to the side wall 22 at different locations if desired. An L-shaped arm 41 is pivotedly attached to the left dogleg lever arm 38 and extends downward such that it engages the handle 40 when the handle 40 is moved approximately one-half of its normal distance of downward travel. As best illustrated in FIGS. 3, 6 and 7, the longer portion, i.e. forwardly projecting portion, of each of the dogleg lever arms 38 has one end of a first connecting cable 42 pivotedly attached thereto. Each of the cables 42 passes through a separate opening in the tabletop 16 of the support frame 14. And, the other end of each of the cables 42 is pivotedly attached to one of the side rails 44 fixedly attached to the opposite ends of a foot pedal 46. The free end of each of the side rails 44 is pivotedly attached to one of the rear legs 18 of the support frame 14 by conventional means, such as a shaft 48 which is passed through a hole near the free end of each of the side rails 44 with one of its ends attached to each of the rear legs 18 at a point slightly above the level of the floor.

The shorter portion, i.e. rearwardly projecting portion, of each of the dogleg lever arms 38 has one end of a second connecting cable 50 pivotedly attached thereto. Each of the cables 50 passes over a pulley 52 rotatably attached to one of the L-shaped side walls 22 and through a separate opening in the tabletop 16. The other end of each of the cables 50 is pivotedly attached to one end of a first counterweight 54. In addition, each of the bearing blocks 34 has one end of a third connecting cable 56 pivotedly attached thereto. Each of the cables 56 passes over a pulley 58 rotatably attached to one of the L-shaped side walls 22 and through a separate opening in the tabletop 16. The other end of each of the cables 56 is pivotedly attached to one end of a second counterweight 60. As illustrated, an operating cable 62 which passes over a pulley 64 rotatably attached to the left L-shaped side wall 22 has one of its ends pivotedly attached to the elongated handle 40 near the front end thereof and the other of its ends pivotedly attached to the left bearing block 34. Alternatively, a suitable mechanical linkage pivotedly attached to the left L-shaped side wall 22 can be substituted for the operating cable 62.

A supporting member 66 rests on and is fixedly attached to the horizontal braces 20 of the support frame 14. A foam rubber cushion 68 or the like rests on and is fixedly attached to the supporting member 66 for receiving and retaining the first counterweight 54. A pair of smaller foam rubber cushions 70 or the like also rest on and are fixedly attached to the supporting member 66 for receiving and retaining the second counterweight 60. A platform 72 having a pair of side rails 74, each of which is pivotedly attached to one of the front legs 18, is provided at the front of the support frame 14 to elevate the operator of the device 10 for easier use of the foot pedal 46.

Referring particularly to FIGS. 4 and 6, a slide bar frame 76 is positioned in the interior of the left spacer 36 such that its associated slide bar 78 is moveably positioned parallel to the L-shaped side walls 22 of the rack compressing assembly 12. The slide bar 78 has a rack engaging member 80 fixedly attached near its front end. While the rack engaging member 80 which is illustrated is cup shaped for receipt of the straight end of an article holding rack R of the type illustrated in FIG. 4, various shapes and sizes are possible for the rack engaging member 80 for compatability with other types of article holding racks. A thumb screw 82 is provided for moving the slide bar frame 76 upward and downward, and, thereby, moving the article holding rack R upward and downward in the rack compressing assembly 12 to vary the height of the points of contact between the plate-like jaws 24 and 26 and the finger pairs F of the article holding rack R. Referring to FIG. 2, a stop 84 is provided at the end of the longer portion of the left side wall 22 to engage the rear ends of the left bearing block 34, the left spacer 36 and the slide bar 78. A hole 86 is provided through the left side wall for insertion of a locking pin which engages the top surface of the longer portion of the left dogleg lever arm 38. Finally, referring to FIG. 7, a bar 90 is fixedly attached to the right spacer 36 at a height above the height of the right bearing way or shaft 30. The bar 90 extends forward in the rack compressing assembly 12 parallel to its L-shaped side walls 22 to function as a rest for the curved or hooked end of the article holding rack R.

Having described the structure of the preferred emobdiment of the device for compressing article racks of the present invention, its operation and use will now be described. With the second plate-like jaw 26 of the rack compressing assembly 12 in its open position as illustrated in FIGS. 1 and 6, an article holding rack R of the type having a plurality of resilient finger pairs F affixed to an elongated member in opposed, longitudinal rows is positioned between the first plate-like jaw 24 and the second plate-like jaw 26. As illustrated in FIG. 4, the rack engaging member 80 on the slide bar 78 receives and retains the straight end of the article holding rack R. Holding the curved or hooked end of the rack R in his or her right hand such that the hooked or curved end of the rack R rests on the bar 90 and one of the rows of finger pairs F is vertically positioned between the first plate-like jaw 26 with their diverging free ends projecting upward, the operator of the device 10 moves the handle 40 of the rack compressing assembly 12 downward with his or her left hand, and, thereby, moves the second platelike jaw 26 into position for compressing the row of finger pairs F. As the handle 40 moves downward, it engages the L-shaped arm 41 which is pivotedly attached to the left dogleg lever arm 38 and moves the lever arm 38 downward to offset the first counterweight 54, and, thereby, drop the foot pedal 46 into position for use.

Figure 5:
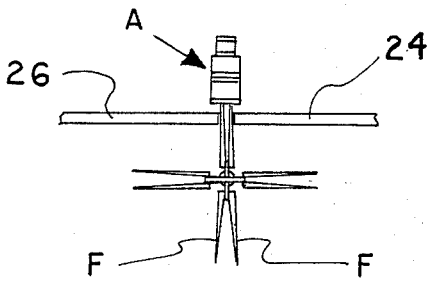
FIG. 5 is a view taken along line 5—5 in FIG. 4 showing one resilient finger pair of an entire row of finger pairs which have been simultaneously compressed by the moveable plate-like jaw.

After the foot pedal 46 drops into position, the operator presses and retains the foot pedal 46 with his or her right or left foot to compress the upwardly projecting row of finger pairs F between the plate-like jaws 24 and 26 as illustrated in FIGS. 2, 4 and 5. Then, the operator places an article A over the free ends of each finger pair F in the row and releases the foot pedal 46 to enable the counterweights 54 and 60 to return the second plate-like jaw 26 to its open position. When the second plate-like jaw 26 returns to its open position, the articles are caught and retained by the outward spring bias of the resilient fingers in each finger pair F. The operator of the device 10 repeats this process until an article is caught and retained on the free ends of each finger pair F on the article holding rack R.

Removal of articles A from the resilient finger pairs F on the article holding rack R following electroplating, anodizing or other coating processes with the device 10 is accomplished in a manner similar to that described above for placement of articles A on the finger pairs F. With the second plate-like jaw 26 in its open position, the operator of the device 10 moves the handle 40 downward until the foot pedal 46 drops into position for use. Then, the operator inserts the locking pin 88 into and through the hole 86 to engage the top surface of the lower portion of the left dogleg lever arm 38, and, thereby, maintain the foot pedal 46 in position for use and the second plate-like jaw 26 in a partially closed position. With the foot pedal 46 and a second plate-like jaw 26 in these positions, the operator can rapidly remove the articles A from a row of finger pairs F by vertically positioning the row of finger pairs F between the plate-like jaws 24 and 26 with the free ends of the finger pairs F projecting downward and pressing the foot pedal 46 to compress the finger pairs F with the second plate-like jaw 26, and, thereby, release the articles A from the finger pairs F. The operator repeats this process until all of the articles A have been released. If desired, a box or other similar container can be placed on the tabletop 16 for receipt of the falling articles A.

While the present invention has been disclosed in connection with its preferred embodiment, it should be understood that there may be other embodiments which fall within the spirit and scope of the invention as defined by the following claims.

We claim:

1. A device for simultaneously compressing a longitudinal row of resilient finger pairs on an article holding rack, the free ends of the fingers of each finger pair being mutually compressible to receive and retain an article, comprising:

(a) a fixed plate-like jaw mounted in a horizontal plane;

(b) a moveable plate-like jaw mounted for movement in the same plane as said fixed jaw between a position adjacent to the edge of said fixed jaw and a position horizontally displaced from said fixed jaw;

(c) a first rack end support mounted for movement below said horizontal plane between a position below the edge of said fixed jaw and a position displaced therefrom less than the displacement of said moveable jaw from said fixed jaw;

(d) means for moving said moveable jaw and said first rack support between their two positions;

(e) means for adjusting the height of said first rack support.

2. A device as recited in claim 1, wherein said means for adjusting the height of said first rack support is a thumb screw.

3. A device for simultaneously compressing a longitudinal row of resilient finger pairs on an article holding rack, the free ends of the fingers of each finger pair being mutually compressible to receive and retain an article, comprising:

(a) a support frame comprising a tabletop and four vertically disposed legs;

(b) a pair of parallel, L-shaped side walls, each of said L-shaped side walls having its longer portion resting on and fixedly attached to said tabletop and its shorter portion extending upward;

(c) a first plate-like jaw fixedly supported in a horizontal plane by said L-shaped side walls, each of the ends of said first plate-like jaw being fixedly attached to the shorter portion of one of said L-shaped side walls;

(d) a second plate-like jaw moveably supported in the same horizontal plane by said L-shaped side walls, each of the ends of said second plate-like jaw being fixedly attached to a bearing block, each of said bearing blocks being moveably positioned on a bearing way which is fixedly supported by the longer portion of one of said L-shaped side walls;

(e) a first rack end support mounted for movement below said horizontal plane;

(f) a pair of identical, dogleg lever arms, each of said lever arms being pivotedly attached to one of said side walls;

(g) a foot pedal having a pair of side rails, the free end of each of said side rails being pivotedly attached to one of said legs of said support frame;

(h) a first pair of connecting cables, each of said cables being positioned such that it passes through an opening in said tabletop of said support frame with one of its ends pivotedly attached to the longer portion of one of said dogleg lever arms and the other of its ends pivotedly attached to one of said side rails;

(i) a first counterweight moveably positioned below said tabletop of said support frame;

(j) a second pair of connecting cables, each of said cables being positioned such that it passes through an opening in said tabletop of said support frame with one of its ends pivotedly attached to the shorter portion of one of said dogleg lever arms and the other of its ends pivotedly attached to one of the ends of said first counterweight;

(k) a second counterweight moveably positioned below said tabletop of said support frame;

(l) a third pair of connecting cables, each of said cables being positioned such that it passes through an opening in said tabletop of said support frame with one of its ends pivotedly attached to one of said bearing blocks and the other of its ends pivotedly attached to one of the ends of said second counterweight;

(m) an elongated handle having one of its ends pivotedly attached to one of said L-shaped walls;

(n) an L-shaped arm pivotedly attached to one of said dogleg lever arms, said L-shaped arm being positioned for engaging said handle when said handle is moved downward approximately one-half of its normal distance of travel;

(o) means for operatively connecting said handle and one of said bearing blocks; and (p) a pair of vertically disposed plate-like members fixedly attached to the under surface of said second plate-like jaw, each of said plate-like members being positioned for engaging the shorter portion of one of said dogleg lever arms when said foot pedal is pressed downward.

4. A device as recited in claim 3, wherein said means for operatively connecting said handle and one of said bearing blocks is a cable having one of its ends pivotedly attached to said handle near its free end and the other of its ends pivotedly attached to said bearing block.

5. A device as recited in claim 4, further comprising a pulley rotatably attached to one of said L-shaped side walls, said pulley being positioned for receiving and retaining said cable.

6. A device as recited in claim 3, further comprising a plurality of pulleys rotatably attached to said L-shaped side walls, each of said pulleys being positioned for receiving and retaining one of said cables.

7. A device as recited in claim 3, wherein the shorter portion of each of said dogleg lever arms has a forked end with a ball bearing rotatably mounted between its prongs.

8. A device as recited in claim 3, further comprising a pair of horizontal braces, each of said braces interconnecting a pair of said legs of said support frame, and a supporting member resting on and fixedly attached to said braces, said supporting member having a cushion resting on and fixedly attached thereto for receiving and retaining said first counterweight and a pair of cushions resting on and fixedly attached thereto for receiving and retaining said second counterweight.

9. A device as recited in claim 3, further comprising a hole in one of said L-shaped side walls and a locking pin for insertion in said hole, said hole being positioned such that said locking pin engages the top surface of the longer portion of one of said dogleg lever arms when inserted in said hole.

10. A device as recited in claim 3, further comprising a platform having a pair of side rails, the free end of each of said side rails being pivotedly attached to one of said legs of said support frame.

* * * * *